United States Patent [19]

Bulka et al.

[11] Patent Number: 4,986,521

[45] Date of Patent: Jan. 22, 1991

[54] REJECT DEVICE FOR A SIGNATURE GATHERING MACHINE

[75] Inventors: Raymond I. Bulka, Oak Lawn; George D. Higgins, Orland Park, both of Ill.

[73] Assignee: McCain Manufacturing Corp., Chicago, Ill.

[21] Appl. No.: 319,093

[22] Filed: Mar. 6, 1989

[51] Int. Cl.[5] ..... B65H 39/02

[52] U.S. Cl. ..... 270/54; 270/58; 198/365

[58] Field of Search ..... 270/52, 54, 55, 57, 270/58; 198/365, 465.1

[56] References Cited

U.S. PATENT DOCUMENTS

| | | | |
|---|---|---|---|
| 3,899,165 | 8/1975 | Abram | 270/58 |
| 4,170,346 | 10/1979 | Murray | 270/54 |
| 4,260,145 | 4/1981 | Mebus | 270/54 |
| 4,497,480 | 2/1985 | Nothdurft | 270/58 |
| 4,799,661 | 1/1989 | Nail | 270/54 |

*Primary Examiner*—Edward K. Look

*Assistant Examiner*—Therese M. Newholm

*Attorney, Agent, or Firm*—Kinzer, Plyer, Dorn, McEachran & Jambor

[57] ABSTRACT

A saddle binding system is provided with a reject device which removes misformed books from the gathering chain and transports them to a tray for recycling. The reject device includes an arm pivotally mounted adjacent the chain on a frame. The arm is normally located in a rest position out of engagement with passing books. An actuator is connected to the arm and is operable to pivot the arm to a raised, book-engaging position. In the raised position the arm elevates the leading edge portion of a misformed book off of the gathering chain, thereby rotating the book. This rotation advances the trailing edge of the book out of engagement with the pusher pin of the gathering chain. A tape-and-roller take-away mechanism is positioned above the chain to engage an elevated edge portion of a book. The take-away mechanism is angled such that it moves the book longitudinally and vertically of the gathering chain, as well as laterally. The book is discharged to a reject tray.

16 Claims, 3 Drawing Sheets

77
78
84
98B
100B
94
86
77
B
94
110B
90
96B
76
108B
102
88
C
104
106B
74
72

REJECT DEVICE FOR A SIGNATURE GATHERING MACHINE

BACKGROUND OF THE INVENTION

This invention relates to saddle binding systems and is particularly concerned with a reject device for removing misformed books from the gathering chain of such a system. A misformed book is one that is missing pages, is misaligned or is otherwise unsatisfactory for use.

A saddle binding system is a group of machines which collate individual printed sheets, called signatures, into finished books. The complete layout of such a system is shown in McCain, U.S. Pat. No. 4,384,709. In saddle binding the signatures are folded and placed one atop another with the folds aligned to define a backbone. This is done by a plurality of signature feeders. A signature feeder is shown in McCain, U.S. Pat. No. 4,241,907. Each feeder places a signature on a gathering chain which has pusher pins to advance a group of signatures past each of the feeders. When a book has passed all feeders, a caliper measures the thickness of the book to test whether it contains all signatures. If so, the book is stapled at the backbone. Thereafter the edges of the book are trimmed and a mailing label may be attached and books may be grouped or tied for shipment.

Occasionally, a signature feeder may fail to properly add its signature to a passing book. Sensors in the signature feeder can detect a misfeed and provide a signal successively to disable downstream feeders when the misformed book arrives at each one. This limits the amount of signatures that are placed on books that are known to be bad. Since the signatures are valuable enough to warrant recycling them from misformed books, the downstream shutoff feature limits the amount of work involved in separating and recycling signatures from misformed books.

Regardless of whether downstream shutoff is used, the stitcher will be disabled so as not to stitch a bad book. The stitcher, however, is set up to handle fully-formed books. Books that vary substantially from the desired thickness have an increased likelihood of jamming the stitcher. Use of the downstream shutoff feature can produce such books. For example, if a misfeed occurs at the fifth feeder of a system with twenty feeders, the downstream shutoff will disable feeders six through twenty from feeding to the bad book. However, the misformed book having only four or five of the expected twenty signatures continues moving with the gathering chain toward the stitcher. The caliper will disable the wire feed of the stitcher heads so the book will not be bound. But the gripper bar that advances books through the stitcher may not be able successfully to grip the thin book and move it through the stitcher.

One possible solution to this problem is to forego the benefits of downstream shutoff. This increases the labor involved in recycling signatures. Another solution is to remove misformed books from the gathering chain before they reach the stitcher area. That is the approach of this invention. However, the high speed of present-day saddle binding systems makes book removal a complex problem. These systems can produce books at a rate of about five books per second. So on average, about a fifth of a second is available between successive books reaching a particular point on the conveyor. This short book cycle leaves very little time to alter the normal course of a book. A further complicating factor is that the removed signatures must be handled carefully so they come out in a reusable condition.

SUMMARY OF THE INVENTION

This invention relates to a reject device for book making machines such as a saddle binding system.

A primary object of the invention is a reject device for removing a misformed book from a signature gathering conveyor which accelerates the book out of engagement with its pusher pin.

Another object of the invention is a reject device of the type described which accelerates the book longitudinally, laterally and vertically of the signature gathering conveyor.

Another object is a reject device which leaves the removed signatures in a reusable condition.

These and other objects are realized by a reject device having an arm pivotally mounted on the gathering chain support frame. The arm is located adjacent the gathering chain in a rest position out of engagement with passing books. An actuator is connected to the arm and is operable to pivot the arm from its rest position to a raised, book-engaging position. When the arm is raised, it elevates the leading edge portion of a misformed book. A sensor is provided to detect a misformed book prior to its approach to the reject device. The sensor generates a signal which activates the actuator at the appropriate time to remove the misformed book from the gathering chain. The reject device further includes a frame having a plurality of shafts mounted thereon. The shafts carry a roller and an endless, moving tape. The tape runs partially around the roller such that the tape and roller present a bight which is aligned with the position of the raised arm. The arm feeds the elevated leading edge portion of the misformed book into the bight. The tape and roller discharge the book into a reject tray arranged on the frame where it will catch rejected books.

DETAILED DESCRIPTION OF THE INVENTION

Figure 1:
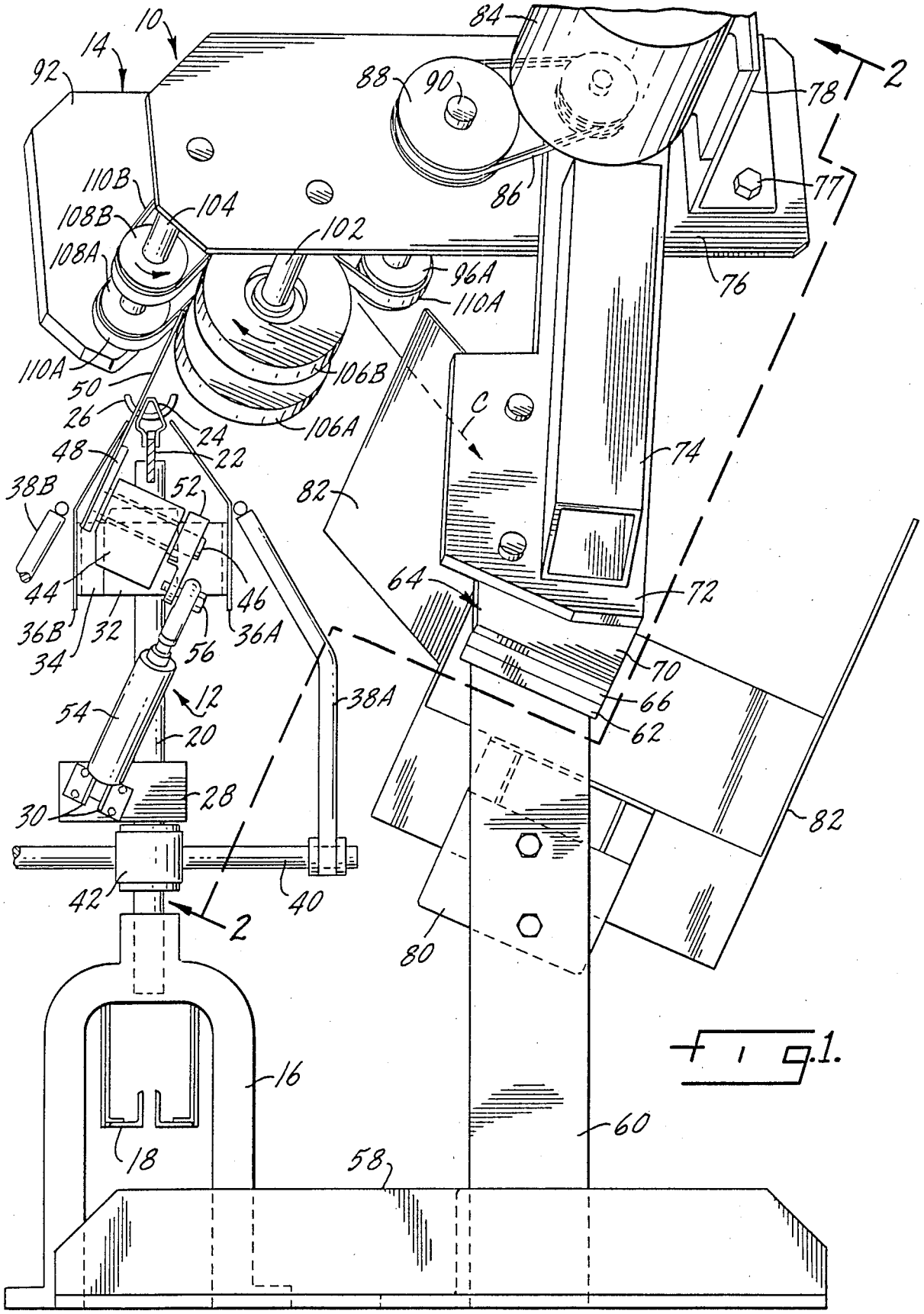
FIG. 1 is an end elevation view of the reject device of the present invention, looking downstream of the gathering chain.
Figure 2:
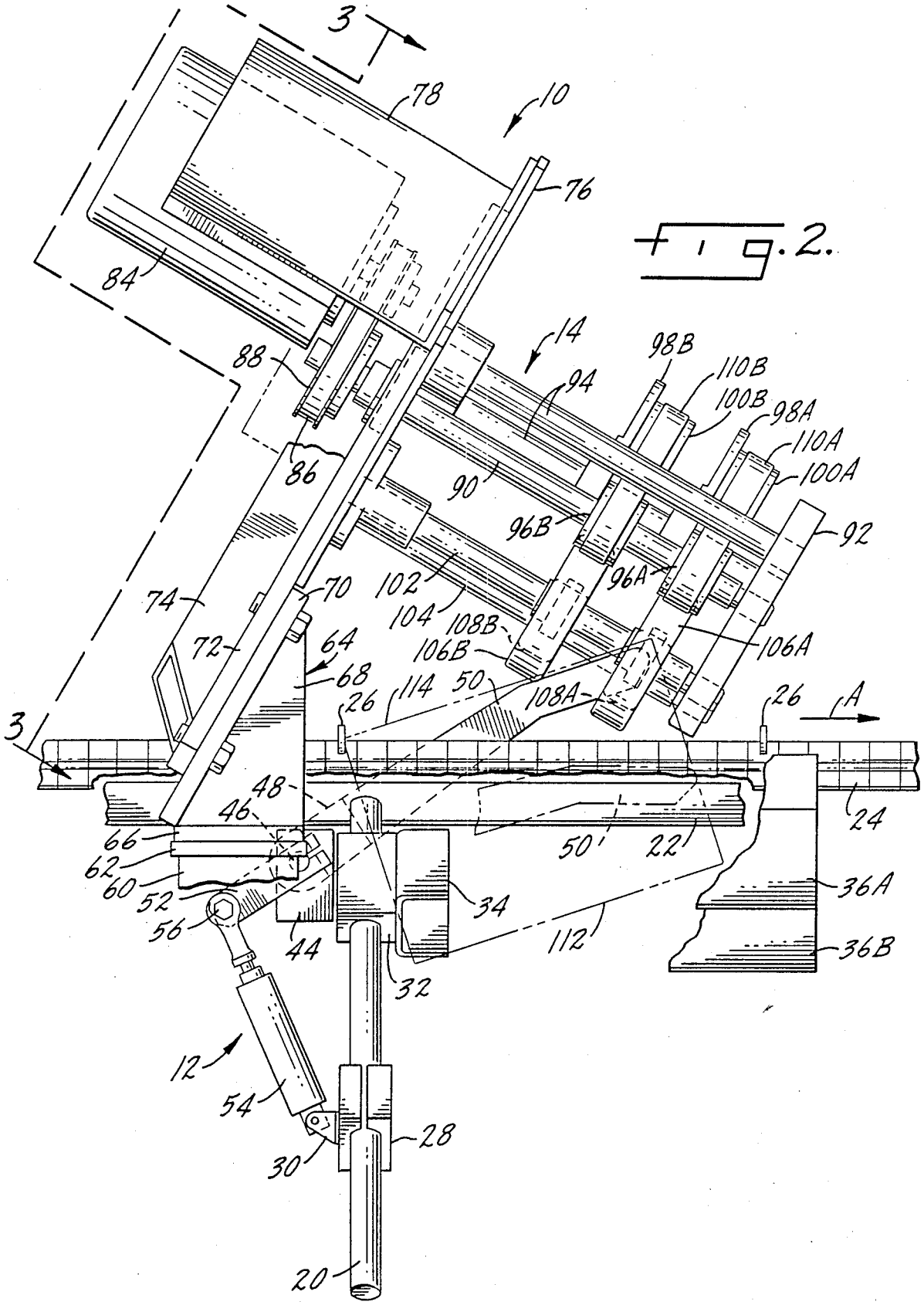
FIG. 2 is a view looking along line 2—2 of FIG. 1.

The reject device of the present invention is shown generally at 10 in FIGS. 1 and 2. The reject device has two sub-systems: a rotator means 12 which is mounted on the gathering chain support frame, and a take-away means 14 which is mounted on its own, independent frame.

The gathering chain support frame includes a U-shaped base 16 resting on the floor. The base supports a gathering chain return box shown schematically at 18. An upstanding post 20 fits in a socket in the top of the base 16. The top of the post 20 has a groove which receives a gathering chain support rail 22. A gathering chain 24 runs along the top of the rail. The chain comprises a plurality of interconnected triangular links. The chain also has pusher pins 26 attached at intervals to the links. The pin spacing is a maximum of twenty-one inches. The chain moves in the direction shown by arrow A in FIG. 2. The parts of the chain and its support described thus far are conventional.

The elements of the rotator means 12 include an air cylinder hanger 28 which is adjustably fixed to the post 20. The air cylinder hanger 28 has pivot brackets 30 fastened on one side. The rotator means further includes a reject arm block 32 adjustably fixed on the post 20 just beneath the gathering chain support rail 22. A saddle plate hanger 34 is fastened to one side of the reject arm block 32. The saddle plate hanger 34 mounts a pair of saddle plates 36A and 36B. The underside of the books is supported by the saddle plates in the vicinity of the reject device. A pair of guide rods 38A, 38B (FIG. 1) restrain the books on the upper side. The guide rods 38 are attached to a cross member 40 which is connected by a bracket 42 to the post 20.

A reject arm hanger 44 is fastened to the reject arm block 32. An opening extends through the reject arm hanger 44 and receives a rock shaft 46. The rock shaft has a plate 48 fastened to one end. The plate mounts a reject arm 50. The reject arm is shown in FIGS. 1 and 2 in a raised position. The reject arm is also shown in a normal, rest position, in phantom in FIG. 2. The reject arm 50 is moved between its rest and raised positions by an air cylinder operating on a crank 52. The crank is fastened to the end of the rock shaft 46 opposite that of the plate 48. The crank in turn is connected to the piston rod of air cylinder 54 by a link 56. The cylinder portion of air cylinder 54 is connected to the pivot brackets 30. The air cylinder 54 is a double-acting cylinder. Its air supply lines and four-way solenoid-operated control valve are not shown.

It will be noted in FIG. 1 that the axis of the rock shaft 46 is tilted with respect to the horizontal. This in turn tilts the plane in which the reject arm 50 moves. The motion of the reject arm defines an eject plane which is angled from the vertical. The angle is chosen such that the eject plane is substantially parallel to the one side of the gathering chain links, as seen in FIG. 1.

Looking now at the take-away means 14, its frame includes a pedestal 58 supporting a pillar 60. The top of the pillar is cut at an angle of about 24° to the horizontal (see FIG. 1). The pillar is capped by a plate 62. The pedestal 58, pillar 60 and plate 62 preferably are fabricated as a single, welded structure.

The upper framework of the reject device includes an adapter shown generally at 64. The adapter is a welded piece having a base 66, braces 68 and a face plate 70. One or more triangular braces 68 (FIG. 2) are welded to the base 66 and the face plate is welded to the braces. The braces 68 support the face plate 70 at angle of 60° to the base 66. The base 66 is bolted to the plate 62.

A reject hanger 72 is bolted to the face plate 70. A square tube 74 welded to the reject hanger provides torsional stiffness. A side frame plate 76 is bolted to the reject hanger 72. Bolts 77 fasten a motor bracket 78 to the plate 76. The reject device frame is completed by a reject tray bracket 80 (FIG. 1) which is bolted to the pillar 60. The bracket 80 supports a reject tray 82.

The moving elements of the take-away means 14 include a one-sixth horsepower, variable speed DC motor 84. The motor is mounted on bracket 78. The motor drives a sprocket 88 by means of belt 86. The sprocket 88 is fixed on the end of a drive shaft 90. The shaft 90 is mounted in bearings carried by the side frame plate 76 and a bearing hanger plate 92. A pair of spacer rods 94 connect the bearing hanger plate 92 to the side frame plate 76. The drive shaft 90 also mounts a pair of drive pulleys 96A,B. A pair of brackets 98A,B mount idler rollers 100A,B.

Figure 3:
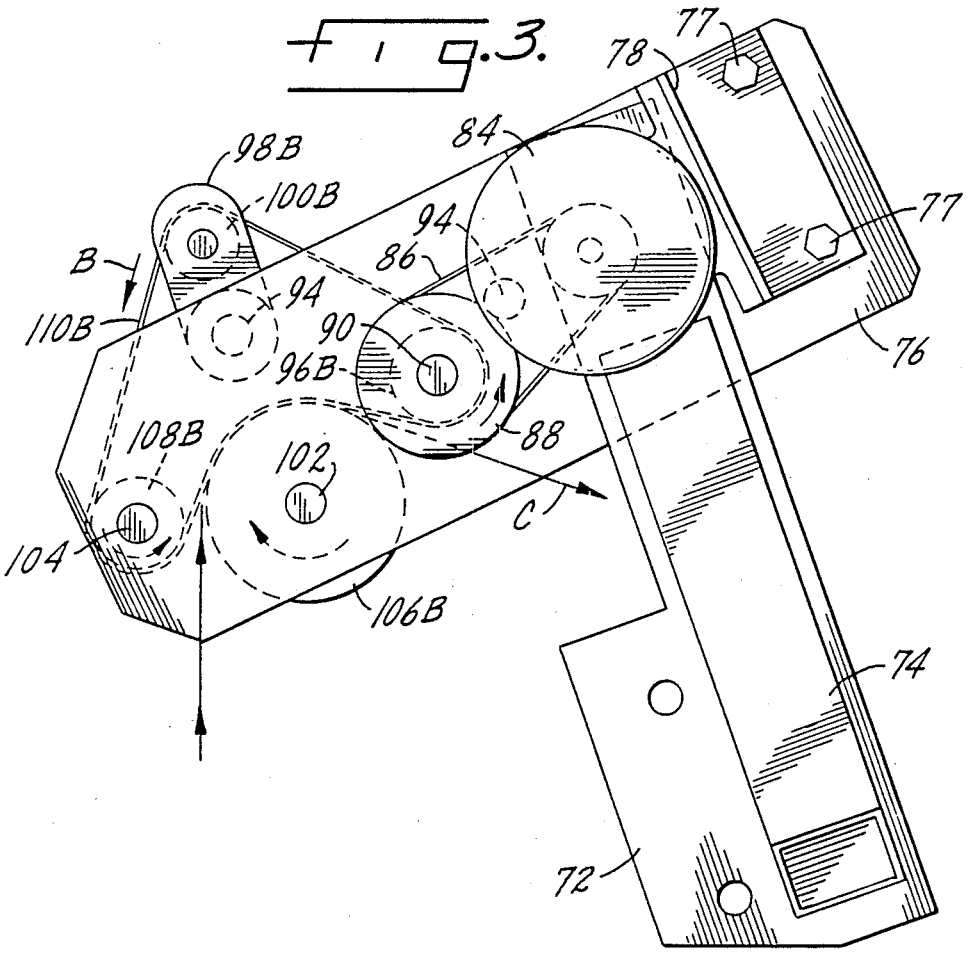
FIG. 3 is a view looking along line 3—3 of FIG. 2.

The take-away means further includes a large roller shaft 102 and a small roller shaft 104. These shafts are mounted in bearings carried by the side frame plate 76 and the bearing hanger plate 92. The larger roller shaft 102 carries a pair of large reject rollers 106A,B. Shaft 104 carries a pair of small reject rollers 108A,B. A pair of belts or tapes 110A,B revolve endlessly about the drive pulleys 96, idlers 100, small reject rollers 108 and large reject rollers 106. This is best seen in FIG. 3. The tapes 110 revolve in the direction of arrow B. The tension on the tapes 110 can be adjusted by altering the position of the idlers 100 on brackets 98.

The tapes 110A,B and large reject rollers 106A,B present a pair of bights to the reject arm 50. Books 112 are fed into the bights, engaged by the tapes 110 and carried around the rollers 106 where they are ejected to the reject bin 82, as indicated by arrow C in FIG. 1. With the shafts angled downwardly toward the gathering chain as shown, the lower tape 110A and roller 106A will grab the book first at about the leading edge of the backbone 114, at first pulling the book up and along the chain. The upper tape 110B and roller 106B will then engage the book near the center of the backbone. As the book rolls around the rollers 106, its component of motion lateral to the chain, originally imparted by the angled reject arm, is increased. The motor 78 drives the tapes 110 at a speed sufficient to maintain the book out of contact with the pusher pin which had been responsible for advancing the book. The speed of motor 78 can be adjusted as required to select an appropriate discharge speed relative to the speed of the gathering chain.

The use, operation and function of the invention are as follows. The gathering chain 24 moves past signature feeders which place signatures onto the chain to create books. Misformed books are identified by misfeed sensors in each feeder, or by sensors along the gathering chain or a caliper (not shown), each located upstream of the reject device. This information is supplied to the process controller. The process controller activates the reject device 10 to remove books that are missing signatures from the gathering chain prior to their arrival at the stitcher.

When a misformed book arrives at a position where it overlies the reject arm 50, the cylinder 54 is activated by the process controller to raise the arm 50 to the raised position. This action of the reject arm elevates the leading edge portion of the book. This is shown in FIG. 2 where the book is indicated in phantom at 112. It will be noted that the effect of elevating the leading edge of the book is to rotate it about a horizontal axis transverse to the gathering chain and through the trailing edge of the book backbone. The backbone is indicated at 114. This rotation of the book accelerates the trailing edge forwardly, out of engagement with the pusher pin 26. Although it appears in FIG. 2 that the trailing edge of the backbone contacts the center of the pusher pin, it will be remembered that the pusher pin is U-shaped (FIG. 1) and the backbone is on the top of the gathering chain links, out of contact with the pin. Thus, the initial consequence of elevating the leading edge portion of the book is to advance the trailing edge out of contact with the pusher pin.

The elevated leading edge portion of the misformed book is fed by the reject arm 50 to the bight of the lower tape 110A and large reject roller 106A. The tape and roller engage the edge of the book and continue pulling it off the gathering chain. Shortly thereafter the book is engaged by the upper tape 110B and roller 106B. The book travels around the large rollers 106 and is discharged to the reject bin 82. It will be noted that the angle at which the take-away means 14 is disposed relative to the gathering chain causes the rejected books to move longitudinally and vertically of the chain. This is evident in FIG. 2. FIG. 1 also demonstrates that the books are moved laterally of the chain as well.

The movement of the reject arm to its raised position is quite fast compared to the forward movement of the pusher pin. Consequently, once the arm contacts the book, the trailing edge of the book will rotate out of engagement with the pusher pin and further movement of the book is solely under the influence and control of the reject device. Once the reject arm passes the book to the take-away means, the longitudinal, vertical and lateral motion of the book is sufficiently fast that the pusher pin never catches up with the trailing edge of the book. This permits removal of the book without the trailing edge being damaged by the constantly-advancing pusher pin.

Whereas a preferred form of the invention has been shown and described, it will be realized that modifications could be made thereto without departing from the scope of the following claims.

We claim:

1. In a signature gathering machine of the type having a plurality of signature feeders which place individual signatures on a moving gathering chain to form books, sensor means for detecting a misformed book, the signatures being draped over the gathering chain with their backbones supported by the chain, the gathering chain including a plurality of pins, each pin being engageable with the trailing edge of a particular group of signatures on the chain to advance said group of signatures past the signature feeders and further to advance fully-gathered books toward finishing stations such as stapling, trimming and labeling stations, the improvement comprising a reject device for removing misformed books from the gathering chain, the reject device comprising:

extractor means responsive to the sensor means for engaging a misformed book and immediately accelerating the trailing edge of said misformed book out of contact with the gathering chain pin associated with that book so as to redirect its path off of the gathering chain and wherein the extractor means comprises take-away means for withdrawing a misformed book from the gathering chain by accelerating the book longitudinally of the gathering chain and simultaneously moving it vertically of the chain.

2. In a signature gathering machine of the type having a plurality of signature feeds which place individual signatures on a moving gathering chain to form books, sensor means for detecting a misformed book, the signatures being draped over the gathering chain with their backbones supported by the chain, the gathering chain including a plurality of pins, each pin being engageable with the trailing edge of a particular group of signatures on the chain to advance said group of signatures past the signature feeders and further to advance fully-gathered books toward finishing stations such as stapling, trimming and labeling stations, the improvement comprising a reject device for removing misformed books from the gathering chain, the reject device comprising:

extractor means responsive to the sensor means for engaging a misformed book and immediately accelerating the trailing edge of said misformed book out of contact with the gathering chain pin associated with that book so as to redirect its path off of the gathering chain and wherein the extractor means comprises rotator means for rotating a misformed book about an axis transverse to the gathering chain and through the trailing edge of the backbone, by elevating the leading portion of the backbone of said book off of the gathering chain with a consequent advancement of the trailing edge of the book out of contact with the gathering chain pin.

3. The reject device of claim 2 wherein the rotator means includes an arm pivotally disposed adjacent the gathering chain in a normal position below and out of engagement with passing books, and an actuator connected to the arm and responsive to the sensor means quickly to pivot the arm to a raised, book-engaging position upon arrival of the misformed book over the arm, the raising of the arm causing the book to rotate about said axis.

4. The reject device of claim 3 wherein the arm pivots in an eject plane which is angled from the vertical such that the arm imparts to the book a component of motion lateral to the gathering chain.

5. The reject device of claim 2 wherein the extractor means further comprises take-away means for withdrawing a misformed book from the rotator means by engaging said elevated leading edge portion of said misformed book and accelerating the book longitudinally of the gathering chain and simultaneously moving it vertically of the chain.

6. The reject device of claim 5 wherein the rotator means includes an arm pivotally disposed adjacent the gathering chain in a normal position below and out of engagement with passing books, and an actuator connected to the arm and responsive to the sensor means quickly to pivot the arm to a raised, book-engaging position upon arrival of the misformed book over the arm, the raising of the arm causing the book to rotate about said axis.

7. The reject device of claim 6 wherein the arm pivots in an eject plane which is angled from the vertical such that the arm imparts to the book a component of motion lateral to the gathering chain.

8. The reject device of claim 7 wherein the take-away means comprises a frame, a plurality of shafts mounted on the frame and carrying a roller and an endless, moving tape which runs partially around the roller such that the tape and roller present a bight to said elevated leading edge of the portion of said misformed book, the book being fed to the bight by the rotator means, the tape and roller engaging the book and directing it to a reject tray, the shafts being parallel to the eject plane but tilted at an angle with respect to the longitudinal axis of the gathering chain such that the tape and roller move the misformed book both vertically and longitudinally of the chain.

9. The reject device of claim 5 wherein the take-away means comprises a frame, a plurality of shafts mounted on the frame and carrying a roller and an endless, moving tape which runs partially around the roller such that the tape and roller present a bight to said elevated leading edge of the portion of said misformed book, the book being fed to the bight by the rotator means, the tape and roller engaging the book and directing it to a reject tray.

10. The reject device of claim 9 wherein the shafts are tilted at an angle with respect to the longitudinal axis of the gathering chain such that the tape and roller move the misformed book both vertically and longitudinally of the chain.

11. The reject device of claim 9 wherein the tape is driven by a motor mounted on the frame.

12. The reject device of claim 5 wherein the rotator means includes an arm pivotally disposed adjacent the gathering chain in a normal position below and out of engagement with passing books, and an actuator connected to the arm and responsive to the sensor means quickly to pivot the arm to a raised, book-engaging position upon arrival of the misformed book over the arm, the raising of the arm causing the book to rotate about said axis, and wherein the take-away means comprises a frame, a plurality of shafts mounted on the frame and carrying a roller and an endless, moving tape which runs partially around the roller such that the tape and roller present a bight to said elevated leading edge of the portion of said misformed book, the book being fed to the bight by the rotator means, the tape and roller engaging the book and directing it to a reject tray.

13. A reject device for removing misformed books from the gathering chain of a signature gathering machine, comprising:

a frame assembly;

an arm pivotally mounted on the frame adjacent the gathering chain in a rest position out of engagement with passing books;

an actuator mounted on the frame and connected to the arm such that when activated the actuator pivots the arm from its rest position to a raised, book-engaging position wherein the arm elevates the leading edge portion of a misformed book, the arm being mounted such that it pivots in an eject plane which is angled from the vertical such that the arm imparts to the book a component of motion lateral to the gathering chain;

sensor means for detecting a misformed book prior to its approach to the reject device and activating the actuator at the appropriate time to remove the misformed book from the gathering chain;

take-away means including a plurality of shafts mounted on the frame and carrying a roller and an endless, moving tape which runs partially around the roller such that the tape and roller present a bight into which is fed the elevated leading edge portion of said misformed book; and a reject tray arranged on the frame so as to catch books discharged thereto by the tape and roller.

14. The reject device of claim 13 wherein the tape is driven by a motor mounted on the frame.

15. The reject device of claim 13 wherein the shafts are parallel to the eject plane but tilted at angle with respect to the longitudinal axis of the gathering chain such that the rollers move the misformed book both vertically and longitudinally of the chain.

16. A reject device for removing misformed books from the gathering chain of a signature gathering machine, comprising:

a frame assembly;

an arm pivotally mounted on the frame adjacent the gathering chain in a rest position out of engagement with passing books;

an actuator mounted on the frame and connected to the arm such that when activated the actuator pivots the arm from its rest position to a raised, book-engaging position wherein the arm elevates the leading edge portion to a misformed book;

sensor means for detecting a misformed book prior to its approach to the reject device and activating the actuator at the appropriate time to remove the misformed book from the gathering chain;

take-away means including a plurality of shafts mounted on the frame and carrying a roller and an endless, moving tape which runs partially around the roller such that the tape and roller present a bight into which is fed the elevated leading edge portion of said misformed book and wherein the shafts are tilted an angle with respect to the longitudinal axis of the gathering chain such that the rollers move the misformed book vertically, laterally and longitudinally of the chain; and a reject tray arranged on the frame so as to catch books discharged thereto by the tape and roller.

* * * * *